United States Patent [19]

Kaito et al.

[11] 4,170,467

[45] Oct. 9, 1979

[54] METHOD FOR PRODUCING HIGH CHROMIUM STEELS HAVING EXTREMELY LOW CARBON AND NITROGEN CONTENTS

[75] Inventors: Hiroyuki Kaito, Takarazuka; Takashi Ohtani; Shoji Iwaoka, both of Ashiya; Yukio Oguchi, Chiba; Shuya Yano, Chiba; Akio Ejima, Chiba, all of Japan

[73] Assignee: Kawasaki Steel Corporation, Kobe, Japan

[21] Appl. No.: 872,992

[22] Filed: Jan. 27, 1978

[30] Foreign Application Priority Data

Jan. 31, 1977 [JP] Japan ..... 52-8713

[51] Int. Cl.[2] ..... C21C 7/10; C22C 33/00

[52] U.S. Cl. ..... 75/49; 75/59; 75/60; 75/130.5

[58] Field of Search ..... 75/49, 59, 60, 130.5

[56] References Cited

U.S. PATENT DOCUMENTS

| | | | |
|---|---|---|---|
| 3,773,496 | 11/1973 | Knuppel | 75/49 |
| 3,788,836 | 1/1974 | Muscatell | 75/49 |
| 3,854,932 | 12/1974 | Bishop | 75/60 |
| 3,971,655 | 7/1976 | Takashima | 75/60 |
| 3,976,473 | 8/1976 | Katayama | 75/49 |
| 4,001,009 | 1/1977 | Bauer | 75/60 |

*Primary Examiner*—P. D. Rosenberg

[57] ABSTRACT

High chromium steels having extremely low carbon and nitrogen contents are produced by blowing more than 15 up to 40 Nl/min per ton of molten steel of an inert gas into a high chromium steel containing 0.8 to 2.5% of C and 10 to 35% of Cr in a ladle under a reduced pressure from bottom of a ladle and concurrently blowing oxygen gas to the molten steel surface to form 1 to 100 kg per ton of the molten steel of a slag containing not less than 20% of $SiO_2$ and not more than 25% of $Cr_2O_3$ at the end of oxygen blowing, terminating the oxygen blowing when the carbon concentration in the molten steel becomes not more than 0.020%, and subsequently blowing 6 to 40 Nl/min per ton of molten steel of an inert gas under a high vacuum of not more than 10 torr.

4 Claims, 6 Drawing Figures

METHOD FOR PRODUCING HIGH CHROMIUM STEELS HAVING EXTREMELY LOW CARBON AND NITROGEN CONTENTS

The present invention relates to a method for producing high chromium steels having extremely low carbon and nitrogen contents by an equipment of degassing a ladle under vacuum.

It has been well known that the reduction of carbon and nitrogen in the method for producing high chromium steels is more difficult than that in the method for producing conventional carbon steels. The reason of the above described difficulty is based on the following facts. That is, the respective activity of carbon (shown by [C] hereinafter) and nitrogen (shown by [N] hereinafter) in molten steels is decreased by chromium (shown by [Cr] hereinafter) in molten steels and $Cr_2O_3$ is preferentially formed in the course of the refining by oxygen blowing and if $Cr_2O_3$ is formed, the decarburization rate is reduced and at the same time the reduction of the nitrogen removal rate is associated.

Heretofore, in order to commercially obtain high chromium steels having not more than 30 ppm of [C], the following two processes have been used.

(1) The material is melted by means of electron beam under high vacuum to evaporate and remove [C] and [N].

(2) The highly pure material having low carbon and nitrogen contents have been previously produced and then said material is melted in a vacuum induction furnace.

However, the above described process (1) is mainly associated with the high running cost of the facilities and the above described process (2) is expensive in the charge material, so that the final products obtained by the above described two processes become considerably expensive. Furthermore the nitrogen content in the products obtained by the above described two processes is only about in the range of 40 to 100 ppm.

In addition, as a process for obtaining the steels having an extremely low carbon content in a mass production system, the following procedures under a reduced pressure have been conducted that 2 to 12 Nl/h per ton of molten steel of oxygen gas is soft blown (blowing a small amount of oxygen gently) on the molten steel surface and on the other hand, 2 to 5 Nl/min per ton of molten steel of an inert gas is blown into the molten steel from porous plugs provided at the bottom of the ladle. However, when a molten steel having a high chromium content is treated with this process, the oxidation of [Cr] occurs at the stage of a relatively high carbon content since Cr is more easily oxidized than Fe, and the decarburization reaction is retarded and therefore it is impossible to obtain Cr steel having an extremely low carbon content of less than 30 ppm.

The applicant has already filed U.S. patent application Ser. No. 858,885 (West German patent application filed on Dec. 7, 1977) wherein alloy steels having an extremely low carbon content are produced in a mass production system by blowing oxygen gas to surface of a molten steel having a high chromium content under a reduced pressure and concurrently blowing a large amount of argon gas from bottom of the ladle, but it has not been always satisfactorily able to obtain the high chromium steel having extremely low carbon and nitrogen contents.

In a process for refining the molten steel by blowing oxygen gas to surface of the molten steel having a high chromium content in a ladle under a reduced pressure, the processes wherein high chromium steels having not more than 0.01% of [C] and not more than 0.01% of [N] are obtained by appropriately setting the original carbon concentration in molten steels have been disclosed in Japanese Patent Publication No. 43,448/76 and No. 44,688/76, but these processes cannot provide the high chromium steel having an extremely low nitrogen content of not more than 40 ppm.

An object of the present invention is to provide a method for producing high chromium steels having an extremely low carbon content of not more than 30 ppm and an extremely low nitrogen content of not more than 40 ppm, which have never been obtained by the above described processes already conducted.

The present invention consists in a method for producing high chromium steels having an extremely low carbon content of not more than 0.0030% and an extremely low nitrogen content of not more than 0.0040%. It comprises blowing of more than 15 up to 40 Nl/min per ton of molten steel of an inert gas from bottom of a ladle into a high chromium steel containing 0.8 to 2.5% of C and 10 to 35% of Cr in a ladle under a reduced pressure and concurrently blowing oxygen gas to the molten steel surface, if necessary feeding at least a kind of silicon alloys and $SiO_2$-containing substances into the ladle to form 1 to 100 kg per ton of the molten steel of a slag containing not less than 20% of $SiO_2$ and not more than 25% of $Cr_2O_3$. The oxygen blowing is terminated when the carbon concentration in the molten steel becomes not more than 0.020%, and subsequently blowing of 6 to 40 Nl/min per ton of molten steel of an inert gas is conducted under a high vacuum of not more than 10 torr.

The present invention will be explained in more detail.

According to the present invention, a molten high chromium steel discharged from a steel making furnace, such as a converter, an electric arc furnace, an open hearth furnace and the like is transferred in a ladle provided with porous plugs at the bottom for blowing an inert gas and put in a vacuum tank. In this case, the carbon content in the molten steel must be within the range of 0.8 to 2.5% and the reason of the limitation of the component composition will be explained based on the experimental data.

FIG. 1 is a drawing showing the relation between the primary carbon concentration prior to the oxygen blowing and the nitrogen concentration after the oxygen blowing and it can be seen that when oxygen gas is blown into the high chromium molten steel having the primary carbon concentration of not less than 0.8%, the final nitrogen concentration after blowing oxygen is not more than 40 ppm, while even if oxygen gas is blown into the molten steel having the primary carbon concentration of less than 0.8%, it is impossible to reduce the nitrogen concentration to not more than 40 ppm. In this drawing, molten steels are classified into three kinds by the primary nitrogen concentrations, that is 250 to 299 ppm (shown by the mark "o" in FIG. 1), 200 to 249 ppm (shown by the mark "⊖") and less than 200 ppm (shown by the mark "•") and this drawing shows that even in the molten steel having the primary nitrogen concentration of more than 250 ppm, the high chromium steels having extremely low nitrogen contents can be obtained, provided that the primary carbon concentration is not less than 0.8%.

On the other hand, when the primary carbon concentration is higher than 2.5%, the decarburization time becomes longer and this is undesirable in view of the efficiency of refining the molten steel in the ladle and of the durable life of refractories, so that said concentration must be not more than 2.5%.

The nitrogen removal proceeds accompanying with the vigorous decarburization reaction, so that in order to obtain the extremely low carbon and nitrogen contents, it is necessary to achieve the large amount of decarburization during the refining under a reduced pressure. However, in the invention of the above described U.S. patent application Ser. No. 858,885 (West German Patent Application filed on Dec. 7, 1977), the primary carbon content has not been necessarily fully high, so that there has been a problem in the stable production of high chromium steels having an extremely low nitrogen content.

In the present invention, the ladle charged with the molten steel is put in a vacuum tank and the inert gas blowing is started and at the same time the pressure in the vacuum tank is reduced and successively oxygen gas is blown to the molten steel surface. During these steps, the blowing may be interrupted in order to, if necessary, conduct the observation of oxygen lance condition, the observation of formation of the slag, taking up samples, measurement of temperature and the like, but the oxygen blowing must be conducted for a necessary time.

The inventors have newly found by various experiments that the optimization of the flow rate of the inert gas is very important in order to achieve the increase of the decarburization rate, to restrain the oxidation loss of [Cr] and to continue the oxygen blowing until the low carbon concentration is attained.

FIG. 2 is a drawing which shows the relation of the flow rate of the inert gas to the carbon concentration and the formed slag compositions at the end of the oxygen blowing in the refining of high chromium molten steels by oxygen blowing under vacuum. In these cases, primary carbon concentration of the molten steels is not less than 0.8%. It can be seen from FIG. 2 that by controlling the flow rate of the inert gas blowing to more than 15 Nl/min per ton of molten steel, the molten steel which has the oxygen blow-end carbon concentration of 0.0030 to 0.0200% can be steadily produced. These values are far below than that of the conventional process and the slag compositions are optimum for the production of the high chromium steels having extremely low carbon and nitrogen contents. In practice, with the said flow rate, $SiO_2$ and $Cr_2O_3$ contents are not less than 20% and not more than 25%, respectively, as illustrated (refer to zone [D] in FIG. 2).

In the zone (B) when the flow rate of the inert gas during oxygen blowing is as small as 5 to 15 Nl/min per ton, the oxidation loss of Cr when blowing oxygen is large and the probability of formation of the slag containing not less than 20% of $SiO_2$ and not more than 25% of $Cr_2O_3$ is only less than 50% and as mentioned hereinafter, the production of the high chromium steels having an extremely low carbon content becomes very unstable.

The above mentioned prior patent application, U.S. patent application Ser. No. 858,885 (West German patent application filed on Dec. 7, 1977) discloses that when the flow rate of the inert gas during oxygen blowing is as small as 5 to 15 Nl/min per ton of molten steel, it is the best way for the prevention of the oxidation loss of Cr to terminate the oxygen blowing when the carbon concentration of molten steel becomes 0.025 to 0.05%.

In the zone (A) in FIG. 2 where the carbon concentration at the end of the oxygen blowing is higher than 0.025%, the probability of formation of the slags containing not less than 20% of $SiO_2$ and not more than 25% of $Cr_2O_3$ is high but as seen from FIG. 3, the percentage for obtaining the final molten steels having the carbon content of not higher than 30 ppm after vacuum treatment with only the inert gas blowing which is subsequently conducted after the oxygen blowing (referred to as "C≦30 ppm obtaining percentage" hereinafter) is, for example 100% when $C_{If} \leqq 200$ ppm ($C_{If}$ is C content at the end of oxygen blowing), while said percentage is about 65% when $C_{If}=300$ to 500 ppm. This shows that the carbon concentration in the molten steel at the stage when the oxygen blowing is terminated must be not more than 0.020% (200 ppm).

In the zone (C), the slags containing not less than 20% of $SiO_2$ and not more than 25% of $Cr_2O_3$ can be formed but the carbon concentration is higher than 0.02%, so that "C≦30 ppm obtaining percentage" is low.

Accordingly, it has been found that in order to stably obtain the final molten steel having the carbon concentration of not higher than 30 ppm, the zone (D) is the most suitable.

An experimental relation between the flow rate of the inert gas during oxygen blowing (referred to as "the first stage of inert gas" hereinafter) and the decarburization efficiency in the refining of high chromium molten steels under vacuum is shown in FIG. 4.

$$\text{Decarburization efficiency} = 100 \times \frac{\text{Actual decarburized amount}}{\text{Theoretical decarburized amount when all oxygen supplied is spent for decarburization}}$$

FIG. 4 is the results when 14 to 30 Nl/min per ton of molten steel of oxygen gas was blown to molten steels having the primary carbon content of 0.8 to 1.8% at a lance height (distance between the lance top end and the molten steel surface) of 500 to 1,500 mm.

From FIG. 4 it can be seen that the stable and large decarburization efficiency of 60 to 90% can be accomplished by blowing the inert gas of the flow rate of more than 15 Nl/min per ton of molten steel and when the flow rate is less than 15 Nl/min, the decarburization efficiency lowers.

In the present invention, when the flow rate of the inert gas is more than 40 Nl/min per ton of molten steel, in the case of treatment of the molten steel of about 50 tons, the durable life of refractories to be used for the refining is considerably shortened, so that the flow rate should be not more than 40 Nl/min. When the flow rate of the inert gas is increased, in practice, splash (scattering molten steel drops) frequently occurs and the difficulty is apt to be caused in view of the operation. In the present invention, in order to overcome this difficulty, a particularly large free board (the upper side wall of the ladle above the molten steel) is provided in the ladle so that the boiling of the molten steel is fully caused and the maximum height of the boiling is adjusted to the height of the free board. By using the inert gas of a large flow rate near 40 Nl/min per ton of molten steel, the level of the molten steel surface always changes and moves, so that the local damage of the ladle lining can be prevented. This is a subordinate characteristic of the present invention.

In the present invention, a larger flow rate of the inert gas then the conventional process is blown, so that even if the flow rate of oxygen blowing is made larger than the conventional process, the decarburization can be conducted by preventing the oxidation loss of Cr and therefore the decarburization rate becomes larger and this is one of the characteristics of the present invention.

In the present invention, the temperature of the molten steel at the end of the oxygen blowing is preferred to be higher than 1,700° C. and when said temperature is lower than 1,700° C., if the oxygen blowing is continued in order to compensate the lowering of temperature which occurs in the course of the vacuum decarburization subsequently conducted, the oxidation of Cr proceeds and the molten steel surface is covered with a hard slag and the rate of the decarburization and the nitrogen removal become slow and it becomes difficult to obtain the high chromium steels having extremely low carbon and nitrogen contents. In order to make the temperature of the molten steel at the end of the oxygen blowing higher than 1,700° C., the ladle is sufficiently preheated or the temperature when the molten steel is charged into the ladle is made higher. Alternatively, Si content prior to oxygen blowing is allowed to be more than 0.4% or Si source is conveniently fed during oxygen blowing to make the temperature of the molten steel higher than 1,700° C.

In the present invention, it is necessary that $SiO_2$ and $Cr_2O_3$ in the component composition of the slag formed by blowing oxygen are not less than 20% and not more than 25% respectively and an amount of the formed above described slag is within 1 to 100 kg per ton of molten steel at the end of the oxygen blowing.

The reason why the above described component composition of the slag is limited, is as follows. As shown in FIG. 5, when the slags containing 15%, 20% and 30% of $SiO_2$ are formed at the end of the oxygen blowing stage, as the amount of $SiO_2$ in the slag increases, the decarburization rate constant $K \times 10^4 (sec^{-1}) (K = -d\ln[\%C]/dt (sec^{-1}))$ becomes larger and when the amount of $SiO_2$ is less than 20%, the decarburization rate lowers, so that $SiO_2$ in the slag must be not less than 20%. Furthermore, when an amount of $Cr_2O_3$ in the slag exceeds 25%, the decarburization rate significantly lowers, so that $Cr_2O_3$ in the slag must be not more than 25%.

When an amount of the above described slag containing not less than 20% of $SiO_2$ and not more than 25% of $Cr_2O_3$ is less than 1 kg per ton of molten steel, the decarburization rate noticeably lowers as shown in FIG. 6. On the other hand, when said amount is larger than 100 kg, the decarburization rate also lowers, so that the amount of slag formed per ton of molten steel must be 1 to 100 kg.

According to the present invention, when the carbon concentration in the molten steel in the first stage becomes not more than 0.020% with the above described treatment, the oxygen blowing is terminated and subsequently 6 to 40 Nl/min per ton of molten steel of an inert gas is blown into the molten steel under a high vacuum of not more than 10 torr to stir vigorously the molten steel to surely reduce the carbon concentration in the molten steel to less than 0.0030%. Furthermore, by extending the time, if necessary the carbon concentration may be reduced to less than 0.0010%.

The reason why the decarburization to the extremely low carbon content can be surely conducted by the above described vigorous stirring, is presumably based on the fact that the interface between the molten steel and the gas phase under a reduced pressure becomes larger due to the above described vigorous stirring, because such a decarburization reaction occurs only at the vicinity of said interface.

When starting the above described treatment, if the carbon concentration in the molten steel after the oxygen blowing is more than 0.020%, it is impossible to make the carbon concentration in the final product not more than 0.0030% as shown in FIG. 3, so that said carbon concentration must be not more than 0.020%. When the vacuum degree after the oxygen blowing is larger than 10 torr in the above described treatment, CO partial pressure becomes higher and it is impossible to make the carbon concentration not more than 0.0030%, so that the vacuum degree must be not more than 10 torr. Furthermore, the flow rate of blowing the inert gas after the oxygen blowing is less than 6 Nl/min per ton of molten steel, it is impossible to surely make the carbon concentration less than 0.0030% as seen from FIG. 3, while when said flow rate is more than 40 Nl/min, refractory bricks at the bottom of the ladle where the inert gas is blown into are noticeably damaged and the operation becomes difficult, so that the flow rate of the inert gas after the oxygen blowing must be 6 to 40 Nl/min per ton of molten steel.

Furthermore, the nitrogen removal is promoted by the violent generation of CO at the first stage when oxygen is blown into the molten steel and at the termination of oxygen blowing, the nitrogen concentration may be reduced to not more than 40 ppm. In the successive vacuum decarburization treatment in which only the above described inert gas is blow, the amount of nitrogen removed is small and in this treatment, the absorption of nitrogen into the molten steel should be avoided by taking such careful procedures in the operation that the leakage of the outer atmosphere containing nitrogen into the vacuum tank is prevented upon maintaining the high vacuum and for example, when exposing air, the flow rate of the inert gas is decreased so that the molten steel surface is not exposed.

The present invention will be explained in more detail.

For a better understanding of the invention, reference is taken to the accompanying drawings, wherein.

Figure 1:
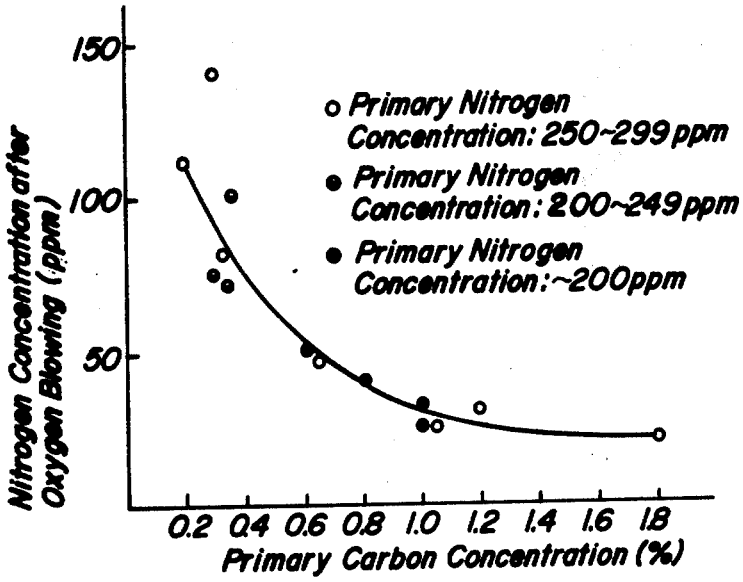
FIG. 1 is a view showing the relation of the primary carbon concentration of the high chromium molten steel to the nitrogen concentration after blowing oxygen under reduced pressure.
Figure 2:
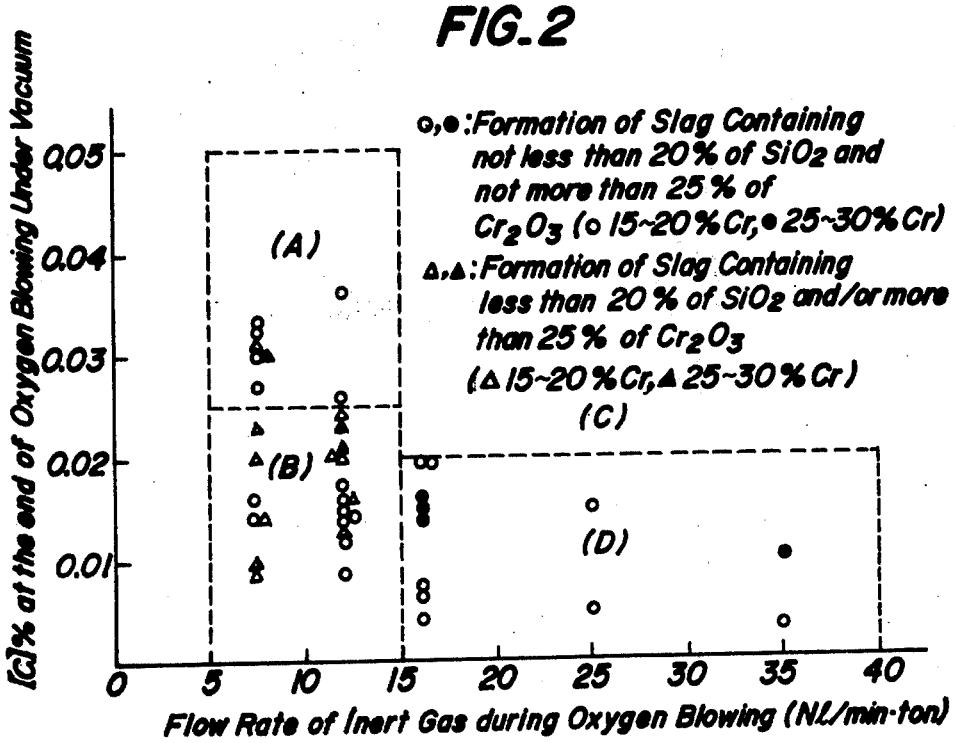
FIG. 2 is a view showing the relation of the flow rate of the inert gas when blowing oxygen to the carbon concentration at the end of oxygen blowing and the formed slag composition at the end of oxygen blowing in the refining of high chromium molten steels under vacuum.
Figure 3:
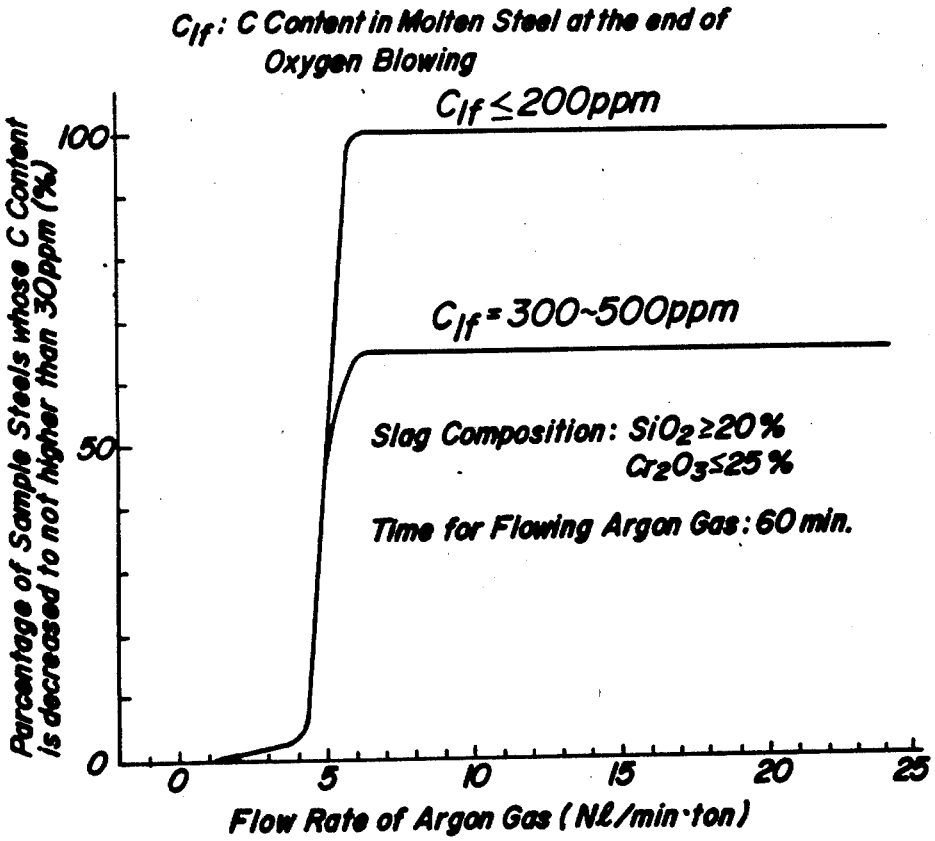
FIG. 3 is a view showing the relation of the flow rate of blowing argon gas after the terminating oxygen blowing to the percentage of sample steels whose carbon content is decreased finally to not higher than 30 ppm in the refining of high chromium molten steel under vacuum.
Figure 6:
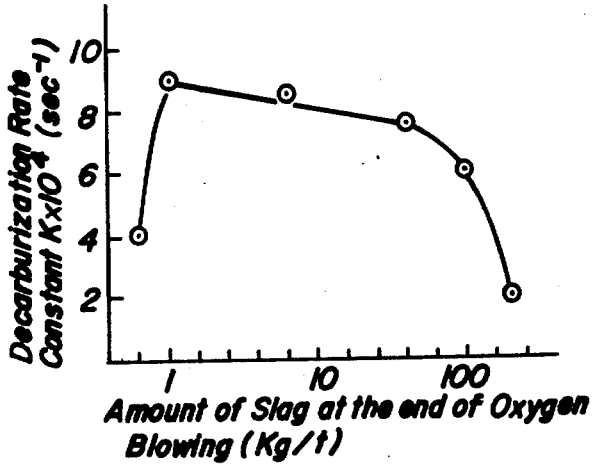
Figure 4:
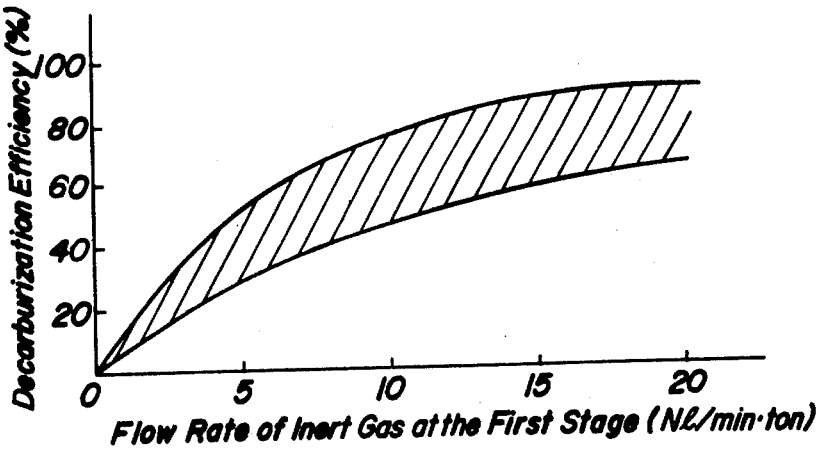
FIG. 4 is a view showing the relation of the flow rate of blowing the inert gas at the first stage (first stage means oxygen blowing period) to the decarburization efficiency in the refining of high chromium molten steel under vacuum.
Figure 5:
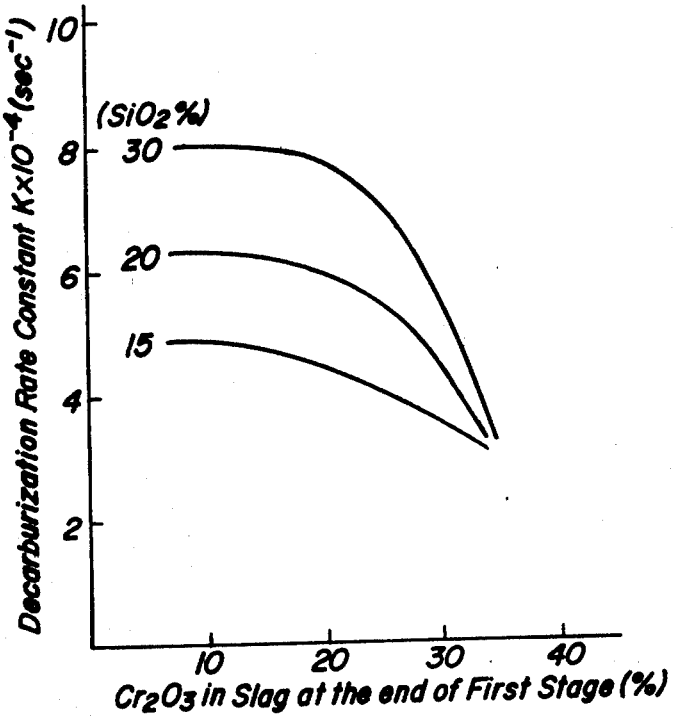

FIG. 5 is a view showing the relation of the content of $Cr_2O_3$ and $SiO_2$ in the slag at the end of the first stage to the decarburization rate constant $K \times 10^4 (sec^{-1})$; and FIG. 6 is a view showing the relation of the amount of the slag formed at the end of oxygen blowing to the decarburization rate constant $K \times 10^4 (sec^{-1})$ in the refining of high chromium molten steel under vacuum.

The following examples are given for the purpose of illustration of this invention and are not intended as limitations thereof.

EXAMPLE 1

50 tons of 17% Cr steel was melted in an electric arc furnace and the molten steel was subjected to desulfurization treatment and charged in a ladle and the slag in the ladle was removed. A primary charge material containing 1.70% of C, 0.60% of Si and 187 ppm of N was obtained. Into this primary charge material, 14 to 30 $Nm^3$/hr per ton of oxygen gas was blown under a vacuum degree of 5 to 60 torr at a lance height of 800 to 1,500 mm while blowing 16 Nl/min per ton of argon gas from bottom of the ladle at temperature in the range of 1,670 to 1,700° C., and when the carbon concentration in the molten steel became 0.0086%, the oxygen blowing under vacuum was terminated. Then, the obtained molten steel had a nitrogen concentration of 20 ppm and a slag containing 18.0% of $Cr_2O_3$ and 27.5% of $SiO_2$ was obtained.

Subsequently, 24 Nl/min per ton of argon gas was blown into the thus treated molten steel under a vacuum degree of 0.5 torr for 90 minutes at temperature of in the range of 1,700° to 1,580° C. to obtain 17% Cr steel having the carbon content of 5 ppm and the nitrogen content of 22 ppm.

EXAMPLE 2

50 tons of 18%Cr-2%Mo steel was melted in an electric arc furnace and the molten steel was subjected to desulfurization treatment and charged in a ladle and slag in the ladle was removed. A primary charge material containing 0.80% of C, 0.70% of Si and 232 ppm of N was obtained. Into this primary charge material, 16 to 30 $Nm^3$/hr per ton of oxygen gas was blown under a vacuum degree of 5 to 60 torr at a lance height of 500 to 1,500 mm while blowing 25 Nl/min per ton of argon gas from bottom of the ladle at temperature in the range of 1,675° to 1,710° C., and when the carbon concentration in the molten steel became 0.0073%, the oxygen blowing under vacuum was terminated. Then, the obtained molten steel had a nitrogen concentration of 23 ppm and a slag containing 12.0% of $Cr_2O_3$ and 27.0% of $SiO_2$ was obtained.

Subsequently, 24 Nl/min per ton of argon gas was blown into the thus treated molten steel under a vacuum degree of 0.5 torr for 40 minutes at temperature in the range of 1,710° to 1,590° C. to obtain 18%Cr-2%Mo steel having the carbon content of 3 ppm and the nitrogen content of 24 ppm.

EXAMPLE 3

50 tons of 27% Cr steel was melted in an electric arc furnace and the molten steel was subjected to desulfurization treatment and charged in a ladle and slag in the ladle was removed. A primary charge material containing 0.83% of C, 0.60% of Si and 293 ppm of N was obtained. Into this primary charge material, 16 to 30 $Nm^3$/hr per ton of oxygen gas was blown under a vacuum degree of 5 to 60 torr at a lance height of 800 to 1,500 mm while blowing 16 Nl/min per ton of argon gas from bottom of the ladle at temperature in the range of 1,680° to 1,720° C.

During blowing oxygen, 2.4 kg per ton of molten steel of FeSi(75%Si) and 2.2 kg per ton of molten steel of FeSi(75%Si) were added into the molten steel separately. When the carbon concentration in the molten steel became 0.0157%, the oxygen blowing under vacuum was terminated. Then, the obtained molten steel had a nitrogen concentration of 35 ppm and a slag containing 11.2% of $Cr_2O_3$ and 32.5% of $SiO_2$ was obtained.

Subsequently, 24 Nl/min per ton of argon gas was blown into the thus treated molten steel under a vacuum degree of 0.5 torr for 40 minutes at temperature in the range of 1,720° to 1,580° C. to obtain 27% Cr steel having the carbon content of 18 ppm and the nitrogen content of 35 ppm.

EXAMPLE 4

50 tons of 26%Cr-1%Mo steel was melted in an electric arc furnace and the molten steel was subjected to desulfurization treatment and charged in a ladle and slag in the ladle was removed. A primary charge material containing 1.52% of C, 0.43% of Si and 246 ppm of N was obtained. Into this primary charge material, 12 to 30 $Nm^3$/hr per ton of oxygen gas was blown under a vacuum degree of 5 to 60 torr at a lance height of 800 to 1,500 mm while blowing 16 Nl/min per ton of argon gas from bottom of the ladle at a temperature in the range of 1,690° to 1,720° C. During blowing oxygen, 180 kg of FeSi(Si=75%) was added to the molten steel. When the carbon concentration in the molten steel became 0.0168%, the oxygen blowing under vacuum was terminated. Then, the obtained molten steel had a nitrogen concentration of 31 ppm and a slag containing 12.5% of $Cr_2O_3$ and 31.0% of $SiO_2$ was obtained.

Subsequently, 24 Nl/min per ton of argon gas was blown into the thus treated molten steel under a vacuum degree of 0.5 torr for 100 minutes to obtain 26%Cr-1%Mo steel having the carbon content of 15 ppm and the nitrogen content of 28 ppm.

Embodiments wherein stainless steels having extremely low carbon and nitrogen contents cannot be produced because these embodiments are beyond the limitations of the present invention, are shown as comparative examples hereinafter.

COMPARATIVE EXAMPLE 1

50 tons of 18%Cr-2%Mo steel was melted in an electric arc furnace and the molten steel was subjected to desulfurization treatment and charged in a ladle and slag in the ladle was removed. A primary charge material containing 1.02% of C, 0.58% of Si and 256 ppm of N was obtained. Into this primary charge material, 14 to 30 $Nm^3$/hr per ton of oxygen gas was blown under a vacuum degree of 5 to 60 torr at a lance height of 800 to 1,500 mm while blowing 12 Nl/min per ton of argon gas from bottom of the ladle at temperature in the range of 1,670° to 1,710° C., and when the carbon concentration in the molten steel became 0.033%, the oxygen blowing under vacuum was terminated. Then, the obtained molten steel had a nitrogen concentration of 25 ppm and a slag containing 26.5% of $Cr_2O_3$ and 31.0% of $SiO_2$ was obtained.

Subsequently, 24 Nl/min per ton of argon gas was blown into the thus treated molten steel under a vacuum degree of 0.5 torr for 85 minutes at a temperature in the range of 1,700° to 1,580° C. and the final carbon content and the final nitrogen content were 68 ppm, 25 ppm respectively.

In this Comparative Example, the flow rate of argon gas when blowing oxygen under vacuum is 12 Nl/min per ton and is insufficient and the carbon concentration when terminating the oxygen blowing under vacuum is 0.033% and is high and the slag composition is 26.5% of $Cr_2O_3$ and 31.0% of $SiO_2$, so that the carbon concentration in the final steel is as high as 68 ppm.

COMPARATIVE EXAMPLE 2

50 tons of 18%Cr-2%Mo steel was melted in an electric arc furnace and the molten steel was subjected to desulfurization treatment and charged in a ladle and slag in the ladle was removed. A primary charge material containing 1.01% of C, 0.60% of Si and 181 ppm of N was obtained. Into this primary charge material, 15 to 30 $Nm^3$/hr per ton of oxygen gas was blown under a vacuum degree of 5 to 60 torr at a lance height of 800 to 1,500 mm while blowing 16 Nl/min per ton of argon gas from bottom of the ladle at temperature in the range of 1,670° to 1,715° C., and when the carbon concentration in the molten steel became 0.038%, the oxygen blowing under vacuum was terminated. Then, the formed molten steel had a nitrogen concentration of 23 ppm and a slag containing 13.0% of $Cr_2O_3$ and 28.3% of $SiO_2$ was obtained.

Subsequently, 24 Nl/min per ton of argon gas was blown into the thus treated molten steel under a vacuum degree of 0.5 torr for 60 minutes at temperature in the range of 1,715° to 1,580° C. and the final carbon content and the final nitrogen content were 38 ppm, 24 ppm respectively.

In this Comparative Example, the carbon concentration at the termination of blowing oxygen is 0.038% and high, so that the carbon content in the final steel is as high as 38 ppm.

COMPARATIVE EXAMPLE 3

50 tons of 18%Cr-2%Mo steel was melted in an electric arc furnace and the molten steel was subjected to desulfurization treatment and charged in a ladle and slag in the ladle was removed. A primary charge material containing 0.88% of C, 0.10% of Si and 230 ppm of N was obtained. Into this primary charge material, 14 to 30 $Nm^3$/hr per ton of oxygen gas was blown under a vacuum degree of 5 to 60 torr at a lance height of 800 to 1,500 mm while blowing 16 Nl/min per ton of argon gas from bottom of the ladle at temperature in the range of 1,690° to 1,720° C., and when the carbon concentration in the molten steel became 0.008%, the oxygen blowing under vacuum was terminated. Then, the obtained molten steel had a nitrogen concentration of 28 ppm and a slag containing 31.5% of $Cr_2O_3$ and 18.1% of $SiO_2$ was obtained.

Subsequently, 24 Nl/min per ton of argon gas was blown into the thus treated molten steel under a vacuum degree of 0.5 torr for 85 minutes at temperature in the range of 1,720° to 1,575° C. and the final carbon content and the final nitrogen content were 41 ppm, 28 ppm respectively.

In this Comparative Example, Si content when starting the oxygen blowing under vacuum is as low as 0.10% but since the addition of Si alloy or $SiO_2$ is not conducted in order to increase $SiO_2$, $Cr_2O_3$ and $SiO_2$ in the formed slag are as high as 31.5% and as low as 18.1% respectively, so that the carbon concentration in the final product is as high as 41 ppm.

What is claimed is:

1. A method for producing high chromium steels having extremely low carbon content of not more than 0.0030% and extremely low nitrogen content not more than 0.0040% using vacuum ladle decarburization apparatus, which comprises transferring to a ladle a high chromium molten steel containing 10 to 35% of Cr, 0.8 to 2.5% of C and not more than 0.06% of N, which is melted in a steel making furnace, putting the ladle in a vacuum tank, then under reduced pressure blowing more than 15 and up to 40 N/min per ton of the molten steel of an inert gas into the molten steel from bottom of the ladle and concurrently blowing 12 to 30 $Nm^3$/hr per ton of the molten steel of oxygen gas to the molten steel surface, terminating the oxygen blowing when the carbon concentration in the molten steel becomes not more than 0.020%, and subsequently under a high vacuum of not more than 10 torr. blowing 6 to 40 N/min per ton of the molten steel of an inert gas to contact the molten steel with a slag of 1–100 kg per ton of the molten steel which contains not less than 20% of $SiO_2$ and not more than 25% of $Cr_2O_3$.

2. The method as claimed in claim 1, wherein Si content prior to oxygen blowing is more than 0.4%.

3. The method as claimed in claim 1, wherein at least one of silicon alloys and $SiO_2$-containing substances is fed into the molten steel in the ladle during the blowing of oxygen under a reduced pressure.

4. The method as claimed in claim 1, wherein a temperature of the molten steel at termination of blowing oxygen is higher than 1,700° C.

* * * * *